US007025643B1

(12) United States Patent
Csitari

(10) Patent No.: US 7,025,643 B1
(45) Date of Patent: Apr. 11, 2006

(54) QUICKFLUSH VALVE KIT FOR FLUSHING AND WINTERIZING OF COOLING SYSTEM OF INBOARD MARINE ENGINES, POWER GENERATORS, AIR-CONDITIONING UNITS, AND SAILBOAT ENGINES

(76) Inventor: Mikulas Csitari, 731 Bobbin Mill Rd., Media, PA (US) 19063

( * ) Notice: Subject to any disclaimer, the term of this patent is extended or adjusted under 35 U.S.C. 154(b) by 0 days.

(21) Appl. No.: 10/948,728

(22) Filed: Sep. 24, 2004

(51) Int. Cl.
*B63H 21/38* (2006.01)

(52) U.S. Cl. ..... 440/88 N; 114/183 R

(58) Field of Classification Search ..... 440/88 C, 440/88 N; 114/186 R; 134/166 R, 166 C, 134/171
See application file for complete search history.

(56) References Cited

U.S. PATENT DOCUMENTS 578,142 A * 3/1897 Fierz ..... 222/144.5
988,899 A * 4/1911 Ryan et al. ..... 134/93
2,343,269 A * 3/1944 Aaron ..... 417/176
3,441,044 A * 4/1969 Rodriguez ..... 137/111
3,550,612 A * 12/1970 Maxon ..... 137/112
4,619,618 A * 10/1986 Patti ..... 440/88 R
5,263,885 A * 11/1993 Montague ..... 440/88 R
5,295,880 A * 3/1994 Parker ..... 440/88 R
6,004,175 A * 12/1999 McCoy ..... 440/88 R

* cited by examiner

*Primary Examiner*—Sherman Basinger

(57) ABSTRACT

A QuickFlush Valve, available in four different versions is a simple, inexpensive device, which allows for a thorough, regular, cost-effective, and convenient flushing or winterizing of cooling systems of inboard marine engines, power generators, and A/C units. At the same time after it is easily installed on boats—either by a boat manufactures or by an owner—it offers years of unmatched reliability, safety and convenience of use for the necessary flushing and wintering thus contributing to extended life expectancy and more efficient operation of inboard marine engines, power generators, and A/C units.

2 Claims, 6 Drawing Sheets

QUICKFLUSH VALVE KIT FOR FLUSHING AND WINTERIZING OF COOLING SYSTEM OF INBOARD MARINE ENGINES, POWER GENERATORS, AIR-CONDITIONING UNITS, AND SAILBOAT ENGINES

CROSS REFERENCE

Reference is made to provisional application #60/471,765 filed May 20, 2003.

BACKGROUND OF THE INVENTION

Field of Invention

This invention relates generally to flushing of saltwater, sediments and debris drawn into water-cooled systems of inboard marine engines, power generators, and air-conditioning units with fresh water or with winterization of said engines, generators and units. The invention can also function as an emergency bilge pump.

U.S. Patent Documents:

| U.S. Pat. No. | Date | Name | Classification |
|---|---|---|---|
| 3,441,044 | April 1969 | Rodriguez | 137/111 |
| 3,550,612 | December 1970 | Maxon | 440/88 |
| 3,946,694 | March 1976 | Belsky | 114/183 |
| 4,619,618 | October 1986 | Patti | 440/88R |
| 5,251,670 | October 1993 | Bates | 137/625.46 |
| 5,263,885 | November 1993 | Montague | 440/88R |
| 5,295,880 | March 1994 | Parker | 440/88R |
| 5,362,266 | November 1994 | Brogdon | 440/88 |
| 6,004,175 | December 1999 | McCoy | 440/88R |

Cooling systems of internal combustion engines such as inboard marine engines, power generators and air conditioning unit installed on power boats use raw water drawn from ambient body of water on which said boats operate. Raw water, i.e. saltwater or water from a lake or a river, carries in the cooling system sand, sediments and other debris, minerals, organic matters which tend to obstruct cooling liquid flow and build deposits in engine's cooling system. Keeping the cooling system free of such damaging particles and deposits by regular and proper flushing considerably prolongs life expectancy and improves performance and safety of operation of said engines, power generators, and air conditioning units.

Similarly, marine engines, power generators, and air-conditioning unit on the boats need to be winterized, i.e. flushed with fresh water and filled with antifreeze liquid.

Great majority of existing and currently operating cooling systems of inboard marine engines, inboard power generators and air-conditioning units do not have flushing and winterizing units installed.

The most frequently used, impromptu, very inconvenient, and costly solution to the need of performing at least somehow effective flushing (and/or winterizing) of said inboard systems is as follows:

A hose (raw water intake conduit) is disconnected from the raw pick up valve ("seacock") and put into a bucket or a similar container. The bucket is being continuously filled with fresh water from a garden hose. With marine engine running and, therefore, the impeller pump engaged fresh water from the bucket is sucked up into engine's cooling system thus flushing it. This procedure is not very effective as the inflow of fresh water from the garden hose and the outflow of water from the bucket, i.e. the water sucked to flush the engine, are very uneven, thus leading to frequent run-outs of water in the bucket, forced shut-downs of engine/impeller pump, and a risk that no water but the air is sucked into the engine's cooling system, creating engine damage and safety hazard. These time consuming and inconvenient procedure, poor accessibility-related to removing and reconnecting intake raw water conduit and working with the bucket in limited space lead to an insufficient and infrequent flushing and subsequent economic loses and an inefficient or less safe engine operation. The raw water intake hose and its hose clamps being each time disconnected and reconnected from the raw water pickup valve are also quickly worn out and damaged.

Similarly to flushing, winterizing—which, unlike flushing needs to be done each year—represents the same set of great inconveniences, problems and expenses as it too requires in most of the cases dry-docking where the cost for each is significant. At this time it varies nationwide between about $300 and $800 for each event. This expense makes it further more unlikely that the cooling systems are being kept clean of said deposits and debris.

Several devices are known in prior art allowing for flushing of the cooling system of marine engines. However it is believed that none of the prior art inventions are of the same structure and that they are able to provide same benefits as the preferred embodiment of the present invention.

Generally, boat manufactures do not install any flushing (and/or winterizing) units because they do not see any unit available on the market as being satisfactory to meet their product reliability with related safety and liability concerns. Very limited number of flushing devices is available in aftermarket.

Only the boats manufactured in recent years (approximately after 1999) and only those with diesel marine engines have an extra valve ("seacock", next to the raw water intake valve, which is generally found, at the very bottom of the boat) offering emergency bilge water pump function. But this solution does not allow for removal of bilge water in any additional compartment of the bilge outside the one where the raw pickup valve and the "seacock" are mounted.

In U.S. Pat. No. 3,441,044 issued on Apr. 29, 1969 to Rodriguez pressure-actuated flush valve for marine engines is disclosed. A movable piston valve switching mechanism controlled by the pressure of the fresh water supply is the basis of said valve. The body is of elongated T-shape with two opposing nipples for in and outflow of cooling water. A sliding piston with an enclosed solid bottom and one hole in its wall matching in size coolant conduit cross-section can move based on helical compression spring action allowing for a wide range of input water pressures. In flushing mode position of the piston hole meets coolant outflow nipple and fresh water flows into cooling system thus flushing it. With pressurized fresh water turned off, spring forces the cylinder to slide up, as bottom part of the piston is to seal off the hollow space for the normal flow of raw water to and from the valve. This device is not being installed apparently due to cost-prohibitive machining of the body bore and matching piston cylinder; sealing action becomes quickly ineffective due to deposits on the bore and piston walls. Tendency for the piston to get stuck in improper position exists. It is visually impossible to verify proper operation or position of the piston visa vie fresh waterhole in it and T-body cooling water outflow nipple. Device does not allow for seacock and raw water conduit back flush. It also doesn't allow for emergency bilge pump operation.

U.S. Pat. No. 3,550,612 issued on Dec. 29, 1970 to Maxon discloses T-shape device with fresh water intake controlled by a spring. Raw water inlet has a ball, not spring loaded against its seat and having holes running through it. The purpose of the holes is to allow for limited back flush of raw water intake conduit by pressurized fresh water. Holes in the ball seem to defy or at least substantially reduce the benefits of the very purpose of flushing of the cooling system as raw water electrolytes, sediments, debris, and harmful minerals are coming in along with pressurized fresh water. The hydraulics of coolant flow seems to be also negatively affected by the fact that the clearance of the ball seat reduces the clearance designed by the engine manufacturer for optimum cooling action. Coolant flow seems to be further affected by inevitable turbulence due to the shape of the hollow body of the device as it has to flow toward the fresh water intake port and back to the port leading to the pump and the engine where the shield design to keep the moving ball further reduces a clearance available to the coolant's flow. Maxon apparently doesn't allow for using non-pressurised fresh water, as it would need to overcome resistance of the spring urging ball valve to keep fresh water intake port closed.

U.S. Pat. No. 3,946,694 issued on Mar. 30, 1976 to Belsky discloses automatic emergency bilge water pumpout system. The system comprises of through-hull water intake pipe for an engine's cooling water pump and a valve for closing the intake of water through the said water intake pipe, another emergency pipe for aspiring water from the interior of a boat bilge and a float for automatic closing off the flow through said water intake pipe and simultaneously opening the valve to the other emergency pipe. The system uses boat engines water pump to dispose of bilge water. It also provides signaling means to alert the boat's pilot to dangerous conditions of water in the bilge.

U.S. Pat. No. 4,619,618 issued on Oct. 28, 1986 to Patti discloses a fresh water flushing kit. The kit includes a conduit system for inboard/outboard marine engines. Conduit has an inlet for fresh water and an ancillary outlet for discharge of seawater overboard during an engine flushing cycle.

U.S. Pat. No. 5,251,670 issued on Oct. 12, 1993 to Bates discloses flush valves for alternatively supplying fresh water or seawater coolant to marine engines.

U.S. Pat. No. 5,263,885 issued on Nov. 23, 1993 to Montague describes electronic winterizer for inboard/outboard engines. Winterizing can be done in or out of the water. After inboard/outboard engine is started, reaches an acceptable temperature and thermostat is opened a switch on driver's console activates an electronic timer that operates DC powered valve and pump. Valve opens, pump starts and drains pre-measured amount of antifreeze from a holding tank and pump dispenses antifreeze through an open valve and into the injector, which is mounted in the engine coolant hose. Antifreeze is injected in such an angle that it mixes with water coolant to a ratio acceptable to prevent the unit from freezing. Engine drive shaft operates pump.

One flushing unit (valve) available on the market is believed to be U.S. Pat. No. 5,295,880, issued on Mar. 22, 1994 to Parker. Parker shows flushing valve composed of a transparent material (plastics) with three ports. First biased check valve prevents outward flow through the first port (water from lake) and prevents inward flow from said port until outside versus inside pressure difference exceeds the set value. Second biased check valve is at the second port (fresh water intake) and the said port is capped unless the engine is being flushed. Device can use both pressurized water and non-pressurized source of fresh water (or winterizing or cleaning liquid). Besides flushing Parker states the invention's objectives are to be modulation of flow of engine coolant to prevent overcooling at lower speeds and though use of transparent material of the valves's body to allow for readily monitoring of valves's operation. Operation of the device in its (three) modes relies on action of its 2 spring urged valves, one being conical plunger (raw water intake), the second one (fresh water intake) being a ball. Design of the device and industry experience suggests several significant shortcomings in intended and actual function leading to its limited use and removal or replacement with other aftermarket flushing devices. It is a standard industry practice for internal combustion engines with cooling system, including marine engines and power generators, to have a thermostat installed to allow for an optimal engine-cooling regime. Such thermostats do not open inflow of ambient (raw) cooling water in the system until a designed optimum temperature of the cooling medium is reached. Thermostat also closes inflow of ambient water in the cooling system if the coolant's temperature might fall below engine manufacturer's preset values. Transparency of the plastics used for the valves's body might be lost due to growing algae and other deposits making visual monitoring of flowing liquids difficult or impossible. Various debris, minerals, sediments and other contaminants tend to deposit on sealing surfaces of conical plunger and ball valves negatively affecting intended sealing function and thus effectiveness or basic operation of the valve. Plastics version of the device seems to be prone to excessive wear (conical plunger and ball valve, threads including cap at fresh water intake. a) Cracking of entire (plastic) units are reported by the industry leading at times to sinking of the boat. While a valve made of plastics has excellent electrolysis resistance characteristics the above-mentioned excessive wear and tear, cracking and short life expectancy made its use limited for claimed safety and economic reasons. Another significant deficiency of plastics version of the device available on the market is the fact that while all on-board metal parts and instruments are required by the law to be properly grounded to prevent progressive corrosion due to electrolysis this device's springs are not grounded thus being constantly and significantly exposed to said progressive corrosion. This corrosion, along with exposure to constant abrasive flow of minerals, debris and particles in raw water, leads to faster damage of desired function of the springs. Cap on the fresh water intake requires its manual removal before any flushing (or winterizing) operation and when the valves body is of plastics, it again leads to excessive wear and more likely malfunction due to damaged sealing action. Spoiler designed to be used at fresh water port when non-pressurized source of fresh water (or winterizing liquid) is to be used seems to be prone to getting lost due to its size and being easily damaged affecting is function. Furthermore, it seems that inserting the spoiler into the port to move the spring-urged ball from its seat inevitably lead to leaking of raw water from the cooling system into bilge. Spring-urged valve at the raw-water port by imposing 10 psi effective resistance pressure seems to undesirably restrict raw water flow and cooling action expected by engine manufacturer for given size of coolant conduit while seemingly duplicating thermal protection of cooling system already addressed by standard thermostat. Empirical experience seems to suggest that with impeller pump running and pressurized fresh water hose attached and fresh water flowing in, a very frequent vacuum is being created in the hollow body of a valve, therefore not exposing conical spring-urged plunger at raw water port to seal sufficiently and, therefore, causing air being sucked in a dry-dock position when seacock might be left open and suction impulses from impeller pump action overcome preset 10 psi spring-urged valves's resistance. Vacuum is also reported to be likely due to the fact that sucking action of the impeller pump is not matched by sufficient inflow of pressurized fresh water, as fresh water port inflow diameter is rather small. Parker's device doesn't allow for back-flush seacock and raw water intake conduit. It also doesn't offer emergency bilge pump function. Per Parker's disclosure, flushing and winterizing modus of operation of the device require dry-dock position of the boat. This substantially defies the very benefit of flushing, as it is desirable that it is done frequently, preferably after each time the engine is running and raw water with impurities flows through its cooling system.

U.S. Pat. No. 5,362,266 issued on Nov. 8, 1994 to Brogdon discloses Flushmaster fresh water flushing system. Two tubular T-shaped interconnection fittings and fresh water valve between them are disclosed.

U.S. Pat. No. 6,004,175 issued on Dec. 21, 1999 to McCoy discloses a flush valve using only one moving component, a ball. Said ball is used to seal either a first or second inlet when the other inlet is used to cause water to flow through the valve. Description of preferred embodiment shows a known type of flushing system, which is available in commercial qualities from Sherwood, a division of Hypro Corp. While McCoy does not mention or disclose the fact anywhere in the specification the device shown in FIG. 1 seems to be identical to Parker's U.S. Pat. No. 5,295,880 described above. Referring to said Parker device McCoy states that "It has been determined that: the movement of the plunger 16 on the edges of the ribs 40 presents a potential jamming area if sand and debris are ingested, in the direction of arrow A, into the region of the spring 18. If this debris inhibits the free movement of the plunger 16, two possible deleterious conditions can occur. First, if the plunger 16 is held against its valve seat 20 by the debris, cooling fluid will not easily pass in the direction represented by arrows A and B when the engine is operating. This could possibly cause an engine failure. If, alternatively, debris prevents the plunger 16 from seating against its valve seat 20, fresh water introduced into the secondary inlet could flow out past the plunger 16 and the inlet 10. This fresh water would not pass through the internal combustion engine and perform its intended flushing operation." McCoy continues: "If spring 18 fails by breaking, the plunger 16 could be free to move back and forth within its chamber and between ribs 40 even though no water is flowing in the direction represented by arrow A. This could allow water to drain from engine when this drainage is not desired. In addition, free movement of the plunger 16, without the resistance provided by the spring 18 would allow fresh water to flow from the secondary inlet 24 to the primary inlet 10 and not in the desired direction through outlet 12 during flushing operations". McCoy further states that "It would be required that the marine propulsion engine be running during the flushing procedure." And he concludes: "It would therefore be beneficial if a flush valve could be developed that did not require the sea water pump to be operated during the flushing process. In order to provide a less expensive flush valve than shown in FIG. 1 and in order to avoid the deleterious results of breakage or internal jamming caused by debris," McCoy presents a "simplified valve". The invention comprises a first inlet and an outlet and a second inlet, a housing structure defining two fluid paths. A moveable sealing device is said ball. Pushed by the pressure of the inflow of either the raw water or, from opposite inlet, via one-way stationary sealing device by fresh water, said ball moves to seal the opposite to incoming flow by forcing it against the respective ball seat. McCoy specifies the ball in one particular embodiment to be made of delrin, precision ground, exactly 1" in diameter plus or minus two one thousands of an inch. Design provides 1.187" clearance for internal diameter to allow debris to pass around the ball and through the outlet. Various O-rings are used to prevent leakage between the valves's parts. Alternatively, the stationary sealing device is said not to be necessary in all embodiments of the invention. McCoy's device does not allow for back-flush of seacock and raw water conduit nor using it as an emergency bilge pump.

BRIEF SUMMARY OF THE INVENTION

It is the principle of this invention, i.e. the Quick Flush Valve, to provide an instrument(s) which allow for achieving as needed performance of flushing (and/or winterizing) tasks on cooling systems of internal combustion engines such as inboard marine engines, power generators and air-conditioning units without the described difficulties, inconveniences, and rapid wear of the cooling system and at the same time achieve a significant time saving and ease of operation in performing these maintenance (flushing) and protection (winterizing) tasks. Secondarily, economic benefits are obtained due to a better upkeep of cooling systems of the engines, power generators or air-conditioning units. The stated objectives are achieved by utilization of invented device.

BRIEF DESCRIPTION OF DRAWINGS

FIG. 6: Is a schematic view of QuickFlush Valve assembly 6 ("Unit 1" shown) illustrates, as FIG. 1, but in more detail, installation relations between a boat's body 1, a marine engine 2, an impeller pump 4, "sea-cock" assembly 7, coolant inflow conduit 23, coolant outflow conduit 24, with an a garden hose 5, or an Emergency Bilge Pump Assembly's hose 9 being alternatively connected to the QuickFlush Valve assembly 6, depending on a specific operation the QuickFlush Valve assembly is being used for.

DETAILED DESCRIPTION OF INVENTION

Figure 2:
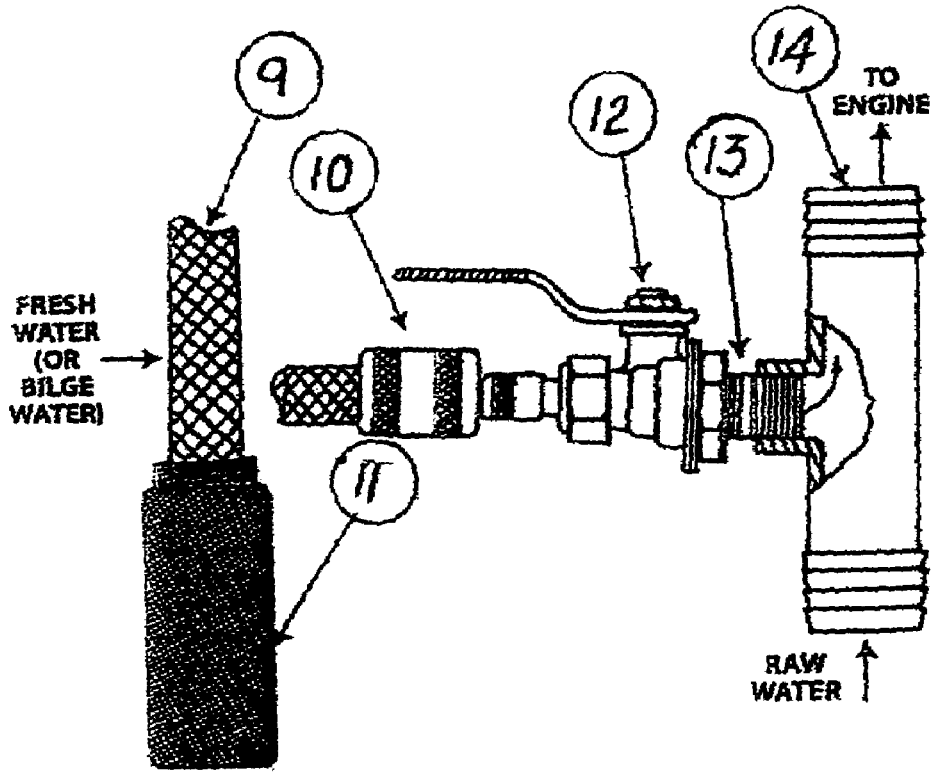
FIG. 2: Is a schematic cross-sectional view of a QuickFlush Valve assembly, version "Unit 1", used for flushing or winterizing, for example, and gasoline marine engines. When pressurized fresh water is used garden hose 5 connects to the QuickFlush Valve assembly 6. Alternatively, when a non-pressurized fresh water is used for flushing or when an engine is winterized, or when bilge water is pumped out, an Emergency Bilge Pump assembly (consisting of a strainer 11, a hose 9, and a quick release coupling 10) is connected to the QuickFlush Valve assembly.
Figure 3:
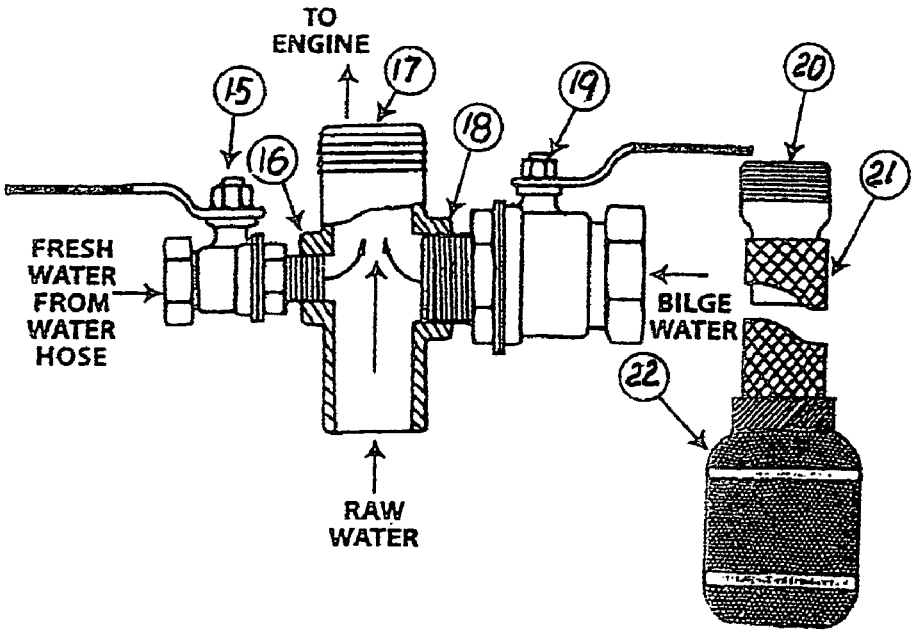
FIG. 3: Is a schematic cross-sectional view of a QuickFlush Valve assembly, version "Unit 2", used, for flushing or winterizing, for example, diesel marine engines. Garden hose assembly can be connected at valve 15. Emergency Bilge Pump assembly (for diesel engines consisting of a strainer 22 and a hose 21) is permanently attached to QuickFlush Assembly.
Figure 4:
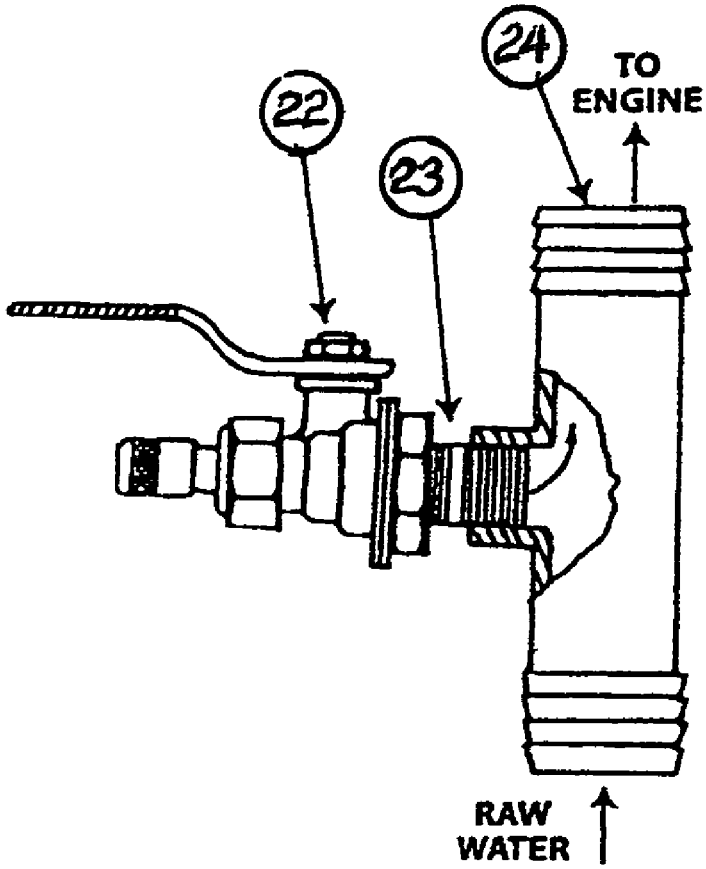
FIG. 4: Is a schematic cross-sectional view of a Quick-Flush Valve assembly, version "Unit 3", used for flushing or winterizing, for example, power generators or A/C units.
Figure 5:
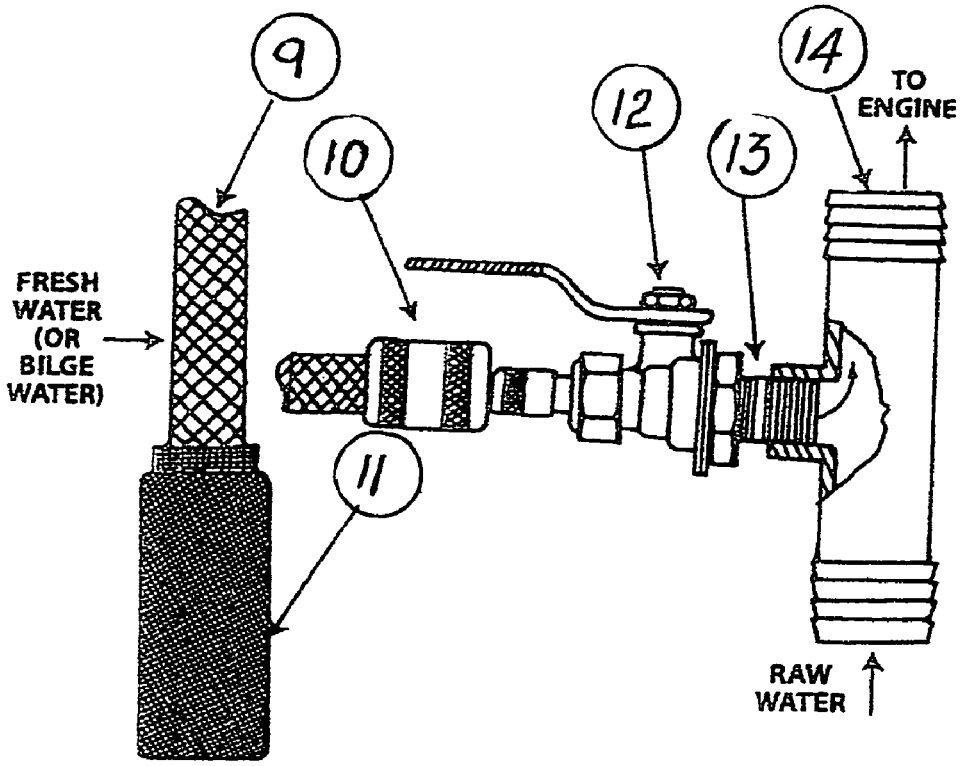
FIG. 5: Is a schematic cross-sectional view of a Quick-Flush Valve assembly, version "Unit 4", used for flushing or winterizing, for example, sailboat's gasoline or diesel engines. When pressurized fresh water is used garden hose 5 connects to the QuickFlush Valve assembly 6. Alternatively, when a non-pressurized fresh water is used for flushing or when an engine is winterized, or when bilge water is pumped out, an Emergency Bilge Pump assembly (consisting of a strainer 11, a hose 9, and a quick release coupling 10) is connected to the QuickFlush Valve assembly. The difference between Unit 4 and Unit 1 (shown in FIG. 2) is sizing of individual parts of the QuickFlush Valve assembly.

Disclosure of four different versions of the invention, the Quick Flush Valve assembly is made:

1) Unit 1 (see FIG. 2)—a QuickFlush Valve assembly used, for example, for Gasoline Engine flushing or winterizing
2) Unit 2 (see FIG. 3)—a QuickFlush Valve assembly used, for example, for Diesel Engine flushing or winterizing
3) Unit 3 (see FIG. 4)—a QuickFlush Valve assembly used, for example, for Power Generator or Air-Conditioning Unit flushing or winterizing
4) Unit 4 (see FIG. 5)—a QuickFlush Valve assembly used, for example, for Sailboats (with gasoline or diesel engines) flushing or winterizing Units 1, 2, and 3 allow for using the device as an Emergency Bilge Pump.

Note: Specific dimensions and sizes of individual parts of the preferred embodiment in Units 1 to 4, including internal or external diameters reflect standard dimensions and parameters accepted and adopted industry-wide by manufacturers of water-cooled internal combustion engines and other inboard systems. These standardized dimensions are, along with cooling water pump performance parameters, results of years of development and testing to provide an optimum and safe cooling water flow characteristics for internal combustion engine operation. Therefore, by maintaining the manufacturer's original coolant conduit sizes, without any obstructions or interferences, disturbances to cooling (or flushing) water flow, the preferred embodiment, unlike several other cited devices, maintains and respects engine design and manufacturer's specification.

Regardless the aforementioned, the invention can be constructed by a person skilled in the art, concerning all dimensions and including said inside and outside diameters of its segments in other sizes and dimensions still providing for all the benefits the invention presents.

Unit 1—(FIG. 2) consists of a T-fitting shape body 14, connected via a fitting 13 to a ball valve 12 to which is permanently attached a male part 10 of a quick release coupling. This male part of a coupling is alternatively connected via a female part 3 of a quick release coupling to an Emergency Bilge Pump assembly or to a garden hose assembly. An Emergency Bilge Pump assembly consists of a high-pressure hose 9, at one end provided with a female part 3 of a quick release coupling and at the other end with a strainer 11. Garden hose assembly consists of a garden hose 5 and, at it end, a female part 3 of a quick release coupling.

Unit 2—(FIG. 3) consists of a cross-fitting shape body 17, with a ball valve 15 connected to it via a fitting 16. To the valve 15 permanently connected male part 10 of a quick release coupling for attaching of a garden hose assembly. Directly opposite to a ball valve, 15 a ball valve 19 connect to the cross-fitting body 17 via a fitting 18. To the valve 19 connects a water fitting 20 and to it connects a reinforced plastic hose 21 with a strainer 22 at its end.

Unit 3—(FIG. 4) consists of a T-fitting shape 24, via a fitting 23 connected to a ball valve 22 with a permanently attached male part of a quick release coupling.

Figure 1:
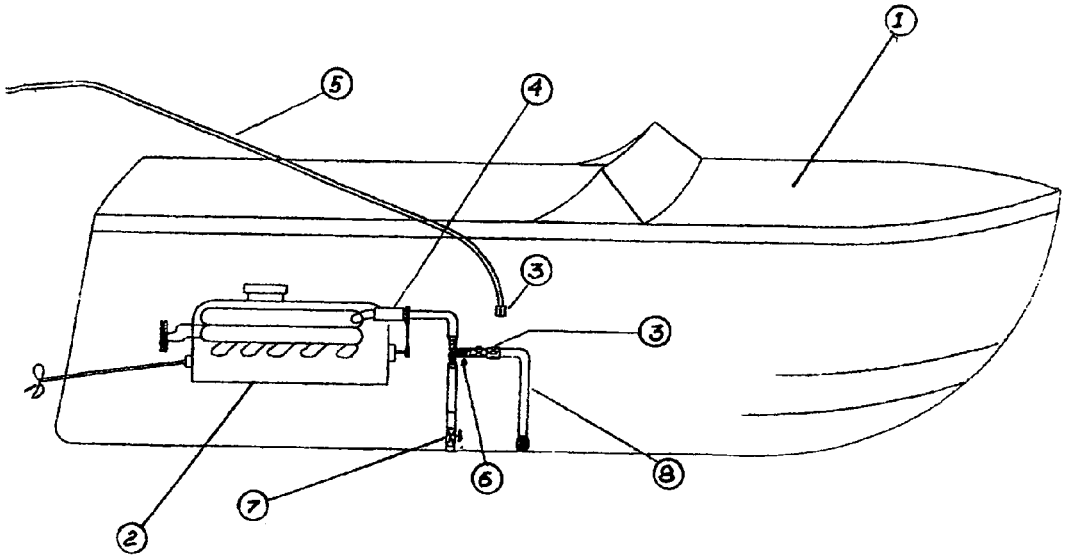
FIG. 1: Is a schematic view of a boat 1, with indicated location of a marine engine 2, where the engine 2 is subject to flushing by pressurized fresh water brought in by a garden hose 5, which is to be connected to a QuickFlush Valve assembly 6 (version "Unit 1" respective "Unit 4" shown). The view specifically shows an Emergency Bilge Pump assembly 8 connected to QuickFlush Valve assembly 6. This combination of an Emergency Bilge Pump assembly 8 and a QuickFlush Valve 6 is used in three different operations: flushing engine 2 with a non-pressurized water, winterizing the engine 2, or pumping up bilge water from the bilge area. The view also shows a relative position of the QuickFlush Valve assembly 6 to an engine's 2 impeller water pump 4 and to a raw water intake valve ("sea cock") 7. QuickFlush Valve assembly Units 2 (used, for example for diesel engines), Unit 3 (used for example for air conditioners or generators) and Unit 4 (used for example for sailboats—with gasoline or diesel engines) are not shown but have similar layout for their respective applications.

Unit 4—(FIG. 5), like Unit 1 (FIG. 1) consists of a T-fitting shape body 14 a ball valve 12 with a male part 10 of a quick release coupling, alternatively connecting via a female part 3 of a quick release coupling to an Emergency Bilge Pump assembly or to a garden hose assembly. An Emergency Bilge Pump assembly consists of a high-pressure hose 9 at one end provided with a female part 3 of a quick release coupling and at the other end with a strainer 11. Garden hose assembly consists of a garden hose 5 and, at it end, a female part 3 of a quick release coupling. Unit 4 to be used for sailboats with both a gasoline as well as diesel engines differs from Unit 1 only in dimensions and sizes of parts number 12, 13, and 14.

All units are manufactured from any durable, wear and marine environment resistant machine investment material selected from the group consisting of bronze, stainless steel, or a nonferrous material.

An Emergency Bilge Pump hose 9 and 21 is made of any suitable, wear, heat/oil and marine resistant material while in the preferred embodiment it is of heat/oil resistant plastic.

Description of Operation:

1) Flushing gasoline marine engine (Unit 1): Marine engine 2 is running, activating impeller pump 4. Attach a garden hose 5 with a female part 3 of a quick release coupling on a hose to a male part 10 of the quick release coupling on the QuickFlush Valve. Open a ball valve 12 and close raw water pickup valve 7 ("seacock"). Flush the engine with pressurized fresh water coming from the garden hose 5. After finishing flushing shut the engine 2 off, close ball valve 12, remove the garden hose 5 and reopen raw water pickup valve 7.
2) Winterizing gasoline marine engine or power generator or an A/C unit (Unit 1): Prior to winterizing the abovementioned flushing procedure is performed. After flushing is completed an engine 2 is shut down. Garden hose 5 is removed from quick release coupling. Emergency Bilge Pump has strainer 11 submerged in antifreeze. Attach Emergency Bilge Pump to QuickFlush Valve by connecting female 3 and male 10 parts of quick-release connection. Restart engine 2, which activates impeller pump 4. Antifreeze is sucked into engine's cooling system until filled up. Engine 2 is turned off and winterization is completed. Ball valve 12 is closed. Raw water pickup valve 7 and ball valve 12 remain closed to keep antifreeze in the cooling system. The same procedure and operation apply to winterizing the boat's power generator and A/C unit.

3) Pumping out bilge water using Emergency Bilge Pump (Unit 1): When boat's standard electric power or standard bilge pump system fail, Emergency Bilge Pump, which is part of Unit 1, can be used. While marine engine 2 continues to run, an Emergency Bilge Pump is attached via female part 3 of a quick-release coupling on its hose 9 to the QuickFlush Valve's male part 10 of the quick-release. Strainer 11 is immersed into bilge water. Ball valve 12 is opened. Afterwards, the closing the intake valve 7 closes raw water pickup line. Impeller pump sucks bilge water up via Emergency Bilge Pump. At the moment where there is no bilge water left to feed the Emergency Bilge Pump, i.e. when the bilge water is pumped out, raw water pickup valve 7 must be opened immediately and, at the same time, ball valve 12 must be closed.

4) Flushing or winterizing diesel marine engines (Unit 2): The operation for flushing is the same as for Unit 1 under 1) and for winterizing under 2) respectively. But the Emergency Bilge Pump is permanently attached at its fitting 20 to QuickFlush Valve's ball valve 19 and Emergency Bilge Pump and garden hose cannot be interchangeably connected to the same valve of the QuickFlush Valve assembly Unit 2.

5) Flushing and winterizing of power generators and A/C units (Unit 3): The operation for flushing is the same as for Unit 1 under 1) and for winterizing under 2) respectively. Unit 3 does not need and, therefore, does not have an Emergency Bilge Pump.

6) Flushing and winterizing sailboat's gasoline or diesel engines, pumping-out bilge water in an emergency (Unit 4): The operation for flushing is the same as for Unit 1 under 1), for winterizing the same as under 2) and for emergency bilge water pumping-out the same as under 3) respectively.

Figure 6:
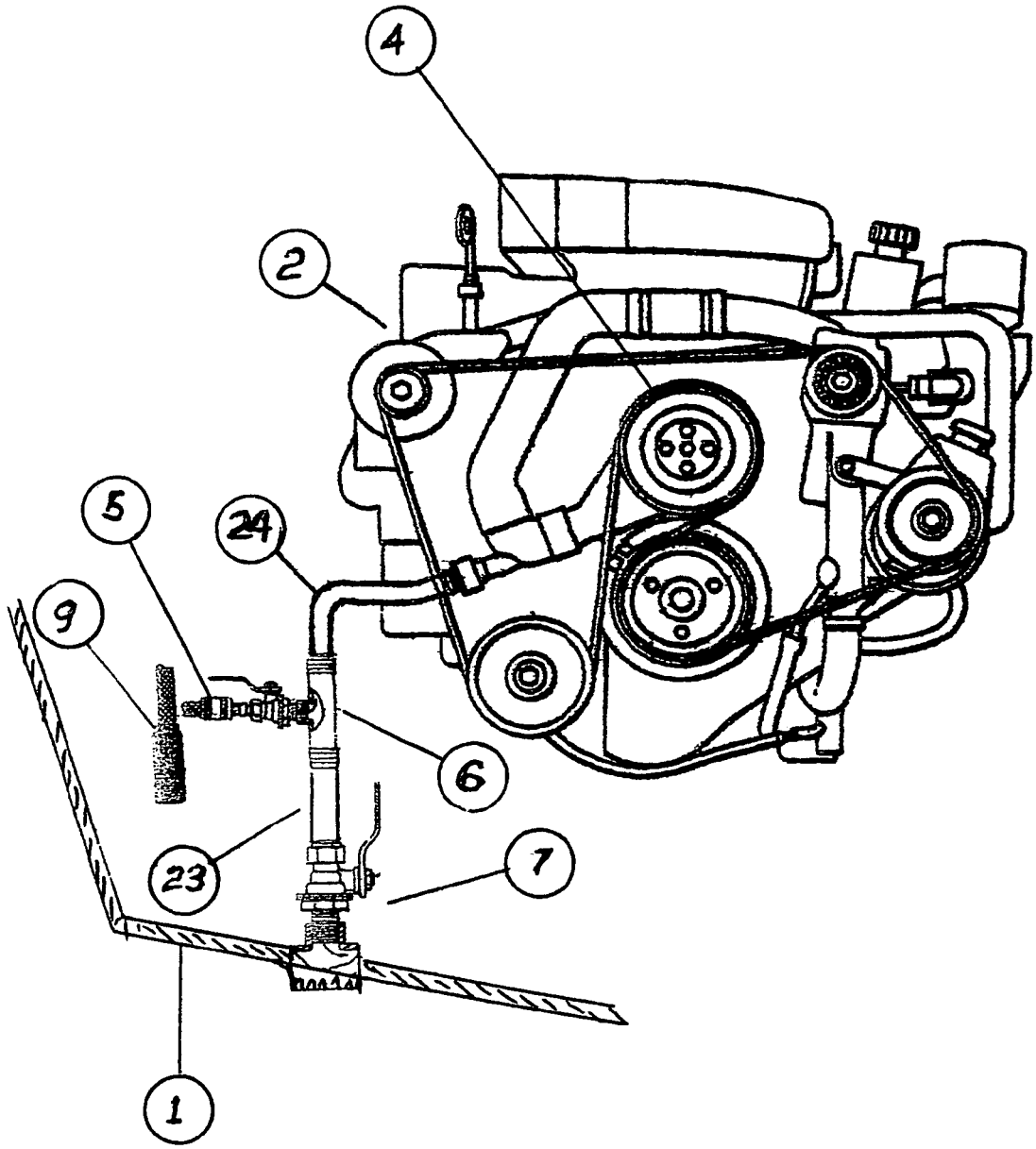

Installation note:

QuickFlush Valve can be installed either:

On existing boats:

By splitting an existing engine's raw water in it connecting raw water pickup valve 7 to the impeller pump 4 into two, i.e. an inflow raw water conduit 23 and outflow raw water conduit 24 and inserting QuickFlush Valve assembly 6 as shown in FIG. 6, or By boat manufacturer on a new boat:

By using instead of a single piece raw water intake conduit two already pre-cut conduits, i.e. an inflow raw water conduit 23 and an outflow raw water conduit 24 as shown on FIG. 6 and installing QuickFlush Valve 6 assembly between them.

QuickFlush Valve is installed in a way which allows for an unobstructed access, easy connection of fresh water garden hose (or an inflow of a winterizing liquid) and for an easy, unobstructed access and operation of the QuickFlush Valve, ensuring instant visual control of the valves's current position.

Given the foregoing teaching, those skilled in the art of which this invention pertains may readily devise further embodiments. Yet other variations and modifications may be achieved without departing from the spirit and scope of this invention.

I claim:

1. A valve for flushing and winterizing a water-cooled internal combustion engine, said valve comprising:

a valve assembly including four branches, a first branch, adapted to be connected to an inflow part of an intake conduit, a second branch, adapted to be connected to an outflow part of the said conduit, a third branch adapted to be connected to a fresh water supply, and a fourth branch adapted to be connected to the bilge of a watercraft;

said third branch having a first valve for controlling flow of fresh water to said valve assembly;

said fourth branch having a second valve for controlling flow of bilge water to said valve assembly;

a hose adapted to be connected to said fourth branch at a first end, a strainer adapted to be connected to said hose at a second end;

and wherein said first valve is used to flush said engine with fresh water and said second valve is used to pump bilge water from the bilge of said watercraft, or to winterize said engine.

2. A flushing and winterizing valve as claimed in claim 1 wherein said valve assembly is cast bronze.

* * * * *